US008690286B2

(12) United States Patent
Aoyama

(10) Patent No.: US 8,690,286 B2
(45) Date of Patent: Apr. 8, 2014

(54) INKJET PRINTING APPARATUS

(75) Inventor: Naoki Aoyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 13/218,614

(22) Filed: Aug. 26, 2011

(65) Prior Publication Data

US 2012/0050379 A1 Mar. 1, 2012

(30) Foreign Application Priority Data

Aug. 31, 2010 (JP) ..... 2010-194741

(51) Int. Cl.
*B41J 29/393* (2006.01)

(52) U.S. Cl.
USPC ..... 347/19; 347/7

(58) Field of Classification Search
USPC ..... 347/7, 19, 29, 84–86, 5
See application file for complete search history.

(56) References Cited

U.S. PATENT DOCUMENTS 5,315,317 A * 5/1994 Terasawa et al. ..... 347/7
7,077,513 B2 * 7/2006 Kimura et al. ..... 347/85
2005/0046650 A1 * 3/2005 Moriyama et al. ..... 347/7
2006/0071954 A1 * 4/2006 Morooka et al. ..... 347/5
2008/0266336 A1 * 10/2008 Maru et al. ..... 347/7
2011/0057971 A1 * 3/2011 Yokoyama et al. ..... 347/7
2011/0205292 A1 * 8/2011 Kneezel et al. ..... 347/29

FOREIGN PATENT DOCUMENTS

JP 63-153147 A 6/1988
JP 2011056721 A * 3/2011 ..... B41J 3/04

OTHER PUBLICATIONS

Machine English Translation of JP 2011-056721.*

* cited by examiner

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

An apparatus which prevents an increase in a print suspension time or the time required to print because of a remaining ink detection operation when there is a sufficient amount of remaining ink. At least one ink tank is monitored to determine if the remaining ink is less than a given amount. If the remaining ink in an ink tank is less than a given amount, printing is suspended and it is determined which ink tank has ink less than the given amount.

11 Claims, 5 Drawing Sheets

INKJET PRINTING APPARATUS

BACKGROUND OF THE INVENTION

1. Field of the Invention

The present invention relates to an inkjet printing apparatus.

2. Description of the Related Art

An inkjet printing apparatus forms an image by ejecting ink supplied from an ink tank and causing the ink to adhere to a print medium. In inkjet printing apparatus, a detector that detects the amount of remaining ink is typically provided in order to prevent faulty printing due to insufficient ink. More specifically, a detector is provided in an ink tank (i.e., the ink supply source), or in the case of a serial printing apparatus, in an ink sub-tank installed on a carriage where a print head is mounted.

If a remaining ink detector is provided in an ink tank, the detector is replaced every time the ink tank is replaced, which is wasteful and expensive as a result. Also, in the case where a remaining ink detector is provided in an ink sub-tank on a carriage, there is a possibility that incorrect operation may occur due to swaying of the ink surface during carriage displacement or that the reliability of electrically connecting parts may lower since such connecting parts also move with the carriage.

Japanese Patent Laid-Open No. S63-153147 (1988) discloses an inkjet printing apparatus provided with a remaining ink detector partway along an ink supply line. A remaining ink detection method disclosed in this publication requires a detector for each ink. For this reason, in the case of increasing the number of ink colors, all detector-related parts must be separately provided for each ink color, and costs increase. Also, in the case where the remaining amount must be successively detected for each color, for example, the time taken to detect the remaining amounts for all inks becomes the product of the remaining ink detection time for one color times the number of ink colors, and total printing time increases.

SUMMARY OF THE INVENTION

It is an object of the present invention to provide an inkjet printing apparatus able to prevent increases in print suspend time or the time required to print because of remaining ink detection operations even when there is a sufficient amount of remaining ink.

The present invention provides an inkjet printing apparatus, includes:

a supplying unit that supplies ink to a print head via a tube by pressurizing ink in a plurality of ink tanks where ink is respectively stored;

a moving mechanism that causes the print head to move;

a controller that controls the print head, the supplying unit, and the moving mechanism so as to cause an image to be printed;

a remaining ink detector that detects the amount of remaining ink in each ink tank while in a state where the ink in the plurality of ink tanks is pressurized;

a first processing unit that divides the plurality of ink tanks into a plurality of groups and detects for each group if there exists an ink tank whose remaining ink is less than a given amount from the detection results of the remaining ink detector;

a second processing unit that determines for each in the plurality of ink tanks if the remaining ink is less than a given amount from the detection results of the remaining ink detector; and memory that stores the detection results of the first processing unit, wherein the controller periodically activates the first processing unit while executing printing operations, and in the case where the information stored in the memory indicates that there exists a group having an ink tank whose remaining ink is less than a given amount, suspends the first processing unit, activates the second processing unit, and determines the ink tank whose remaining ink is less than a given amount.

According to the present invention, an inkjet printing apparatus is provided which prevents an increase in a print suspension time or the time required to print because of a remaining ink detection operation when there is a sufficient amount of remaining ink.

Further features of the present invention will become apparent from the following description of exemplary embodiments (with reference to the attached drawings).

DESCRIPTION OF THE EMBODIMENTS

Figure 1:
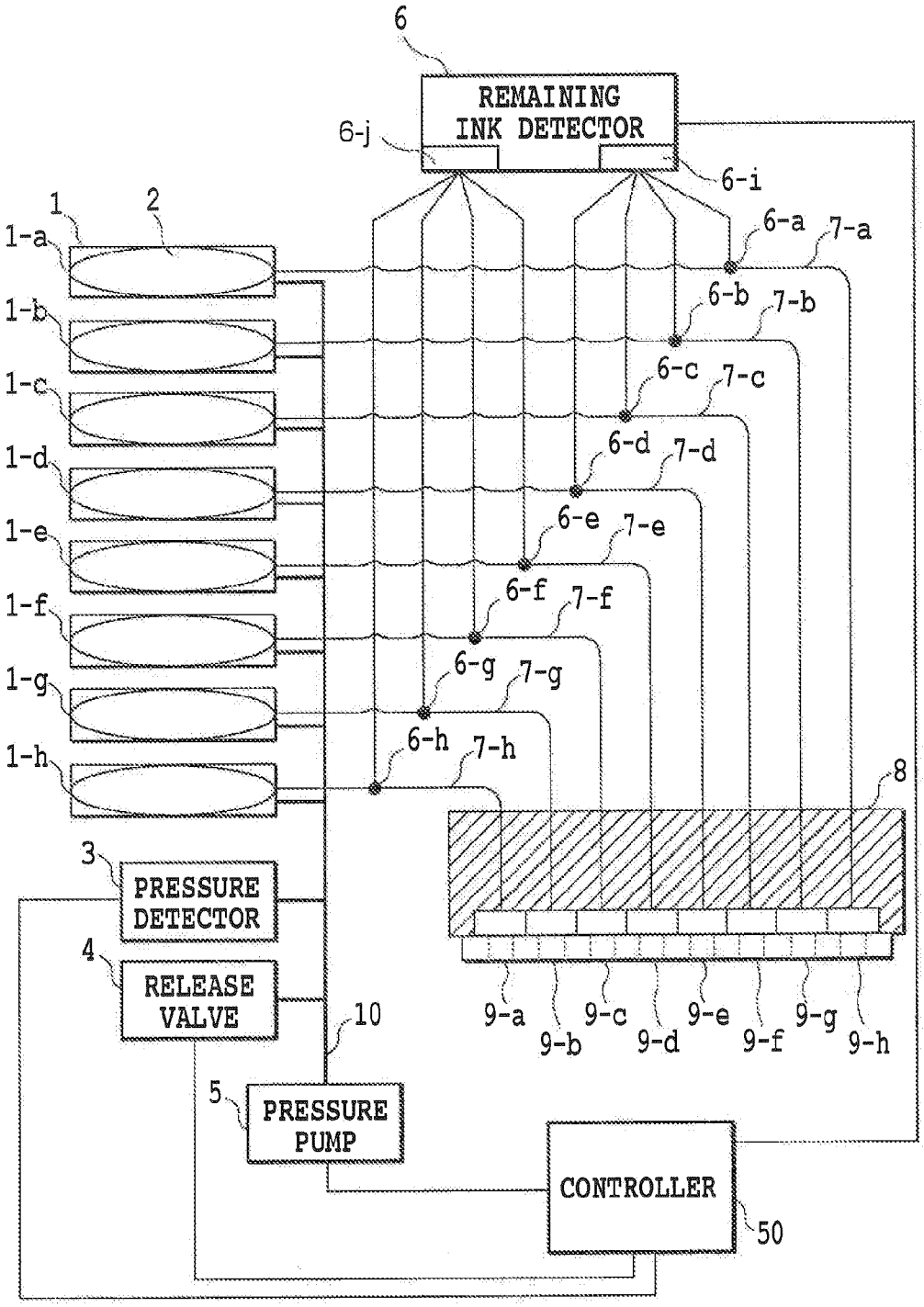
FIG. 1 conceptually illustrates an ink supply system and a printing system of an inkjet printing apparatus in accordance with an embodiment of the present invention.

Hereinafter, an ideal embodiment of the present invention will be described in detail by way of example. FIG. 1 illustrates a partial configuration of an inkjet printing apparatus (hereinafter, printing apparatus) in accordance with an embodiment of the present invention. The printing apparatus in FIG. 1 implements a system that pushes ink out from ink bags inside ink tanks by applying pressure inside the ink tanks, and supplies the ink to a head via tubes. 1 represents an ink tank that stores ink, while 1-*a* to 1-*h* represent respective ink tanks for each color. 2 is an ink bag containing ink. A pressure pump 5 feeds in air into an air supply line 10 between an ink tank 1 and an ink bag 2, and pressure is applied to the ink bag 2. In so doing, ink is pushed out from per-color tubes 7-*a* to 7-*h*, and the ink is supplied to the per-color nozzles 9-*a* to 9-*h* of a print head 8. At this point, the currently applied pressure is monitored by a pressure detector 3, and the pressure pump 5 is controlled such that ink can be supplied stably. 50 is a controller (controlling means). The controller 50 is electrically coupled to the respective components of the printing apparatus, and comprehensively controls the printing apparatus.

6-*a* to 6-*h* are optical sensors provided along the ink supply lines which detect any remaining ink. More specifically, diaphragms are installed along the ink supply lines, and in the case where there is sufficient ink, the membranes of the diaphragms are pushed by the pressure of ink supplied by the pressure pump 5, and light entering the photosensitive parts of the optical sensors 6-*a* to 6-*h* is masked. In contrast, in the case of no ink, the diaphragm membranes are not pushed even if pressure is applied by a pressure pump, and thus the light entering the photosensitive parts of the optical sensors 6-*a* to 6-*h* is not masked. In addition, the outputs of the optical sensors 6-*a* to 6-*h* along the per-color ink supply lines are coupled to remaining ink detection channels 6-*i* and 6-*j* of a remaining ink detector 6. The remaining ink detection channels 6-*i* and 6-*j* of the remaining ink detector 6 take the voltages of the photosensitive parts of the optical sensors 6-*a* to 6-*h* as input, convert the voltages into a digital signal with an AD converter, and output the digital signal.

The remaining ink detector 6 determines if there is remaining ink according to whether the values of the output results from the optical sensors 6-*a* to 6-*h* are equal to or greater than a given threshold value, or less than the threshold value. Also, the remaining ink detector 6 has two remaining ink detection modes with respect to the channels 6-*i* and 6-*j*.

The first mode outputs a logical sum of the detection results for the remaining ink in each of the ink tanks in each of a plurality of groups. Consequently, in the first mode, in a case where light that is entering the photosensitive parts of the optical sensors is not masked within a particular ink group, the output voltage of those photosensitive parts becomes the output voltage for that group. In other words, in the case where the output from the optical sensors coupled to a channel indicates that the amount of ink remaining in at least one ink tank is less than a given amount, the channel output result is a value that indicates the "remaining ink is less than given amount".

The second mode outputs the remaining ink detection result for a specified ink tank within a particular group. Consequently, in the second mode, the voltage of the photosensitive part of the optical sensor corresponding to the specified ink tank is input into the channel. In other words, in the case where the output of the optical sensor for the specified ink color indicates that the remaining ink is less than a given amount, the channel output result becomes a value indicating "remaining ink is less than given amount". In addition, the remaining ink detector 6 is formed to be able to switch between these two modes.

Also, in the ink supply system installed in this case, any remaining ink is detected by ink pushed out by pressure. For this reason, during heavy-duty printing in which large amounts of ink are expended from the nozzles of the print head or during suction operations, there is a possibility that, strictly speaking, the remaining ink is not less than a given amount. Consequently, as soon as the cap is removed, ink is ordinarily pressurized and supplied to the print head to bring about a state where ink can be ejected. At the same time, a detection mode is set in the remaining ink detector 6 such that at least one of the optical sensors 6-*a* to 6-*h* coupled to the channels 6-*i* and 6-*j* detects a lack of ink. Similar settings are set during printing and suction operations.

Furthermore, in the case where the remaining ink in at least one ink tank is less than a given amount, printing and suction operations are suspended, and a mode detecting any remaining ink with respect to tubes coupled to the specified channel is re-set. After that, a process is conducted to respectively detect whether or not the remaining ink is less than a given amount for all inks.

In the present embodiment, in the case where it is determined that there is an ink tank on a channel for which the remaining ink is less than a given amount, a remaining ink detection process is conducted on all inks on the other channel. This is done from the perspective of the accuracy and reliability of the remaining ink detection process when expending ink, and also in consideration of additional ink tank replacements and the time involved in suction operations, etc. due to a replacement in the case where the process fails to detect a lack of remaining ink due to detection variation. In other words, improvements in remaining ink detection accuracy may obviously enable the choice of conducting a remaining ink detection process on just the ink tanks in a single channel in the case where it is determined that the remaining ink is less than a given amount in one of the ink tanks on that channel. Moreover, it is also possible to resume printing after detecting a channel having an ink tank whose remaining ink is less than a given amount in the case where the detection results for all ink tanks indicate that the remaining ink is equal to or greater than a given amount.

Figure 2:
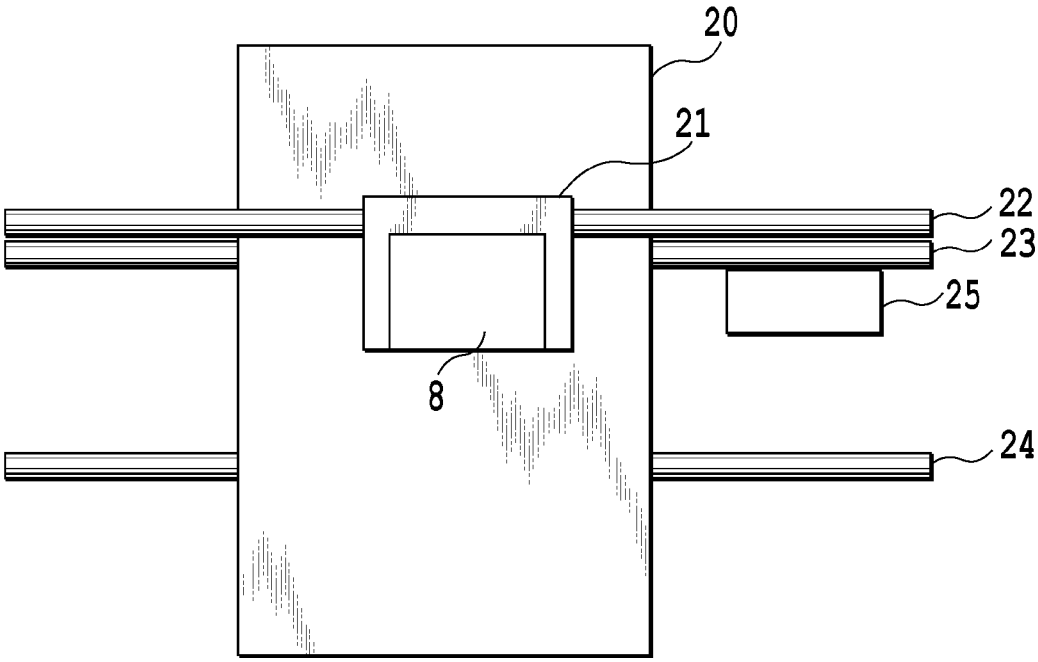
FIG. 2 schematically illustrates a top view of the printing system in the printing apparatus in FIG. 1.

FIG. 2 schematically illustrates a top view of a partial configuration of a printing apparatus when printing in accordance with an embodiment of the present invention. 20 is a print sheet, and a conveying mechanism that conveys the sheet with conveying rollers 23 and 24 is installed. 21 is a carriage for mounting a print head, and 22 is a guide shaft for supporting the carriage 21. A moving mechanism that causes the carriage 21 to scan by means of this guide shaft 22 is installed. Additionally, an image can be formed on the print sheet 20 by causing the carriage to scan while ejecting ink from a print head and conveying the print sheet 20 with the conveying rollers 23 and 24. 25 is a cap member, and a recovery mechanism that causes this cap member 25 to ascend and descend is installed. By moving the carriage 21 to above the cap member 25 and causing the cap member 25 to move upward, the front surface (nozzle forming face) of the print head can be sealed.

Figure 3:
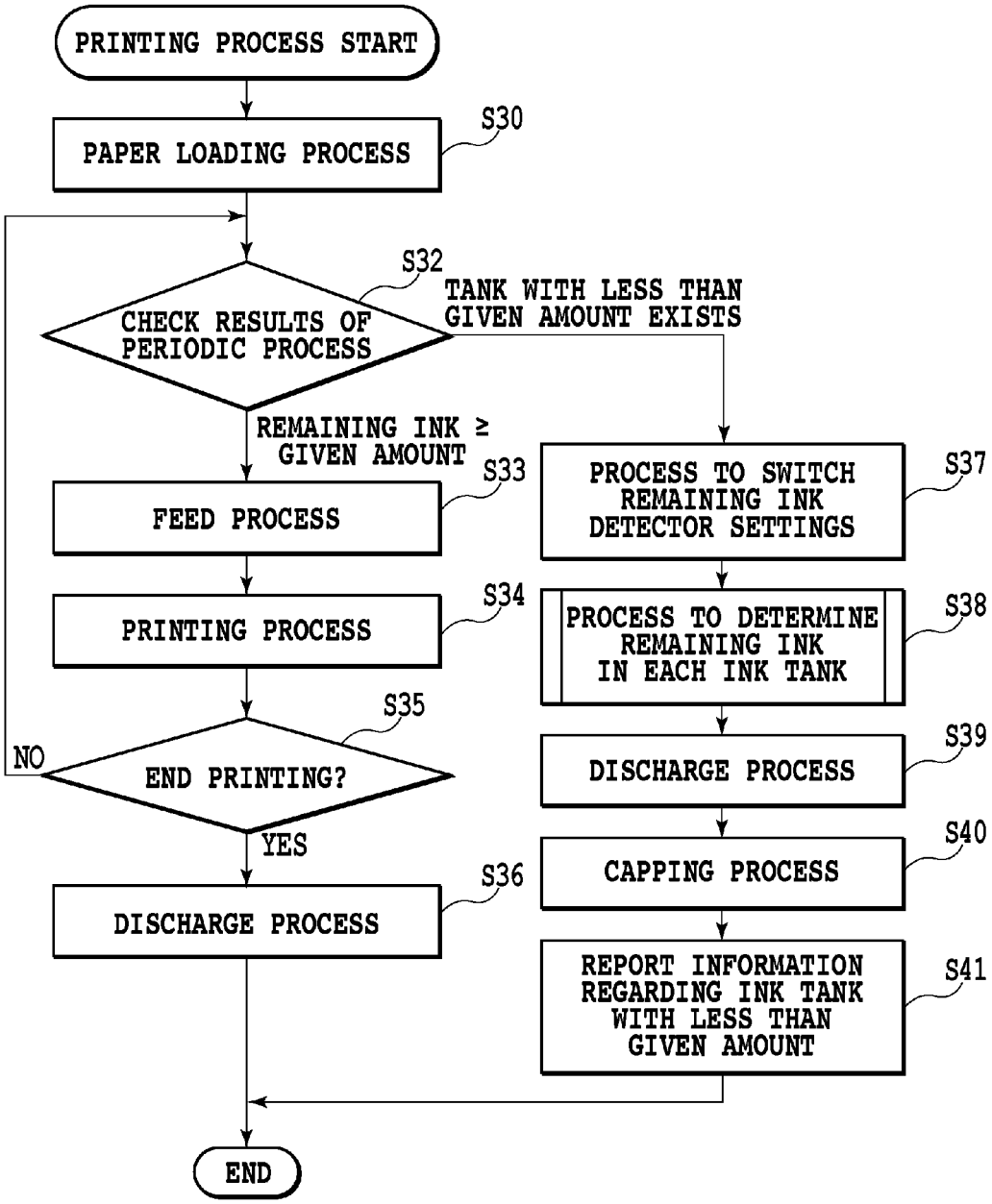
FIG. 3 is a flowchart illustrating processing during printing in the printing apparatus in FIG. 1.

FIG. 3 is a flowchart illustrating control during printing in accordance with an embodiment of the present invention. This control is executed by the controller 50.

As discussed earlier, as soon as the cap is removed, ink is supplied by a pressure pump, and a first mode is set in the remaining ink detector 6 such that at least one of the sensors in tubes coupled to channels detects a lack of ink. Additionally, a process performed by the flowchart in FIG. 4 later described is activated at a 10 ms interval and executed in the remaining ink detector 6. By means of this process, a process detecting any remaining ink is conducted for each channel, and the results thereof are used in a print (printing operation) control. This control will be explained hereinafter.

First, a paper loading process is conducted (step S30), and a print sheet is moved to a position where the sheet can be conveyed by the conveying rollers. Next, a remaining ink detection process is periodically activated, and the detection results obtained by performing the process are checked to determine if the remaining ink in at least one ink tank is less than a given amount (step S32). When there is no ink tank whose remaining ink is less than a given amount, the sheet is moved in the conveying direction by a feed process in step S33, and in a printing process in step S34 the carriage is made to scan while ink is ejected from the print head. Then, it is determined whether printing has finished (step S35). In the case where the results from the periodic process to be described in detail later indicate that the remaining ink in all ink tanks is equal to or greater than a given amount, these processes, i.e., the processes in steps S32 to S34, are repeatedly conducted in accordance with print data. After the print process ends, the print sheet is discharged outside the device in step S36, and the printing of a single page ends.

Also, in the case where there exists an ink tank whose remaining ink is less than a given amount in step S32, in step S37 the remaining ink detector 6 is made to suspend the remaining ink detection process for a channel which is activated at a 10 ms interval and executed.

Figure 5:
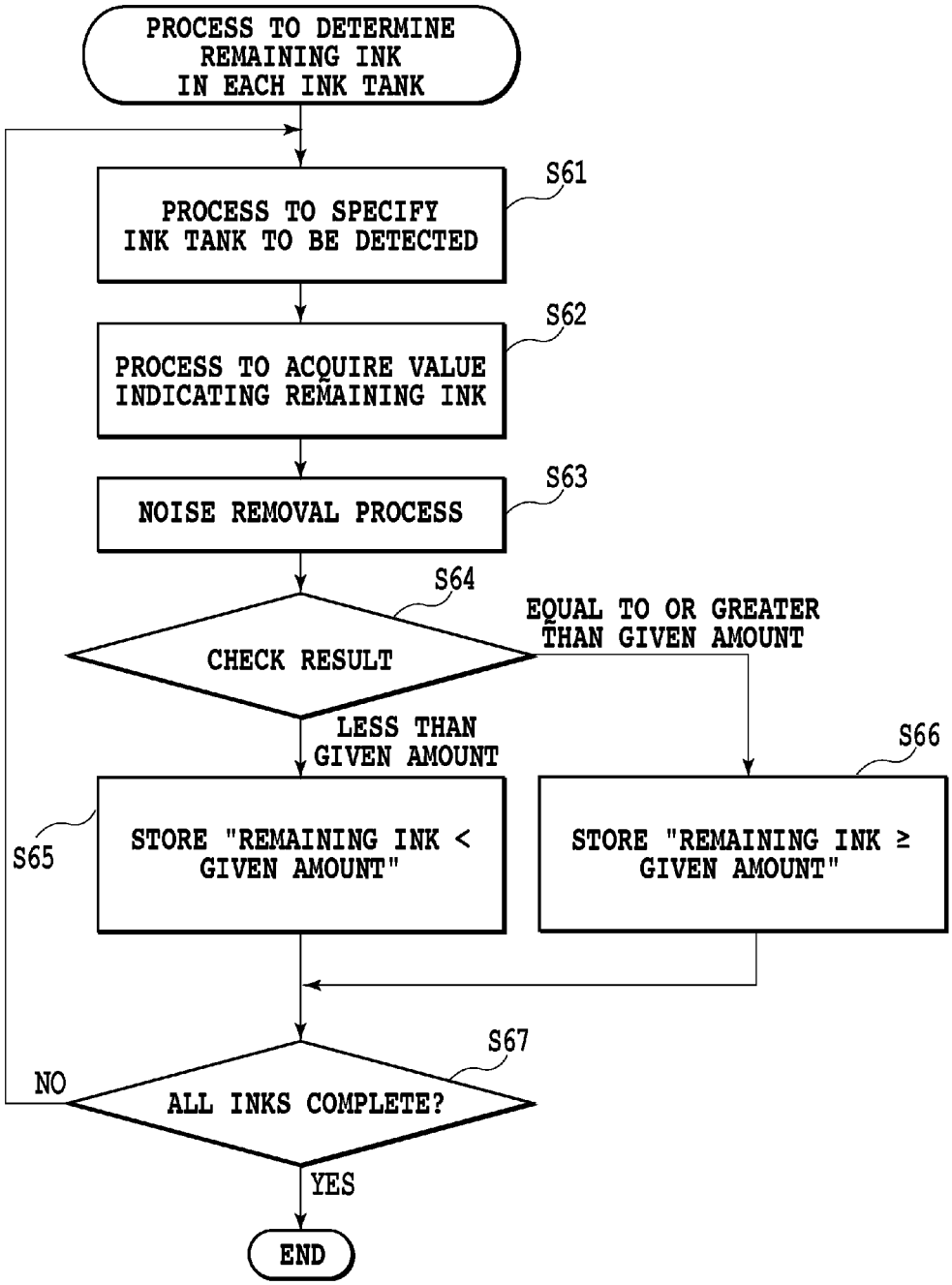
FIG. 5 is a flowchart of an ink tank level determination process in the printing apparatus in FIG. 1.

Next, a second mode, i.e. a mode that detects the remaining amount of a specified ink is set for a channel. After that, as illustrated in FIG. 5 to be discussed in detail later, respective ink colors coupled to a channel are specified and checked sequentially one by one to determine if the remaining ink is less than a given amount, thus determining whether the remaining ink is less than a given amount for all ink tanks (step S38). After that, the sheet is discharged outside the device in step S39, and the print head is capped in step S40. Doing so avoids ejections while in a state where ink cannot be supplied, and also prevents faulty ejections due to the print head drying as a result of not ejecting ink. After that, in step S41 the user is notified with the information regarding whether or not the remaining ink in respective ink tanks is less than a given amount that was determined in step S38.

Figure 4:
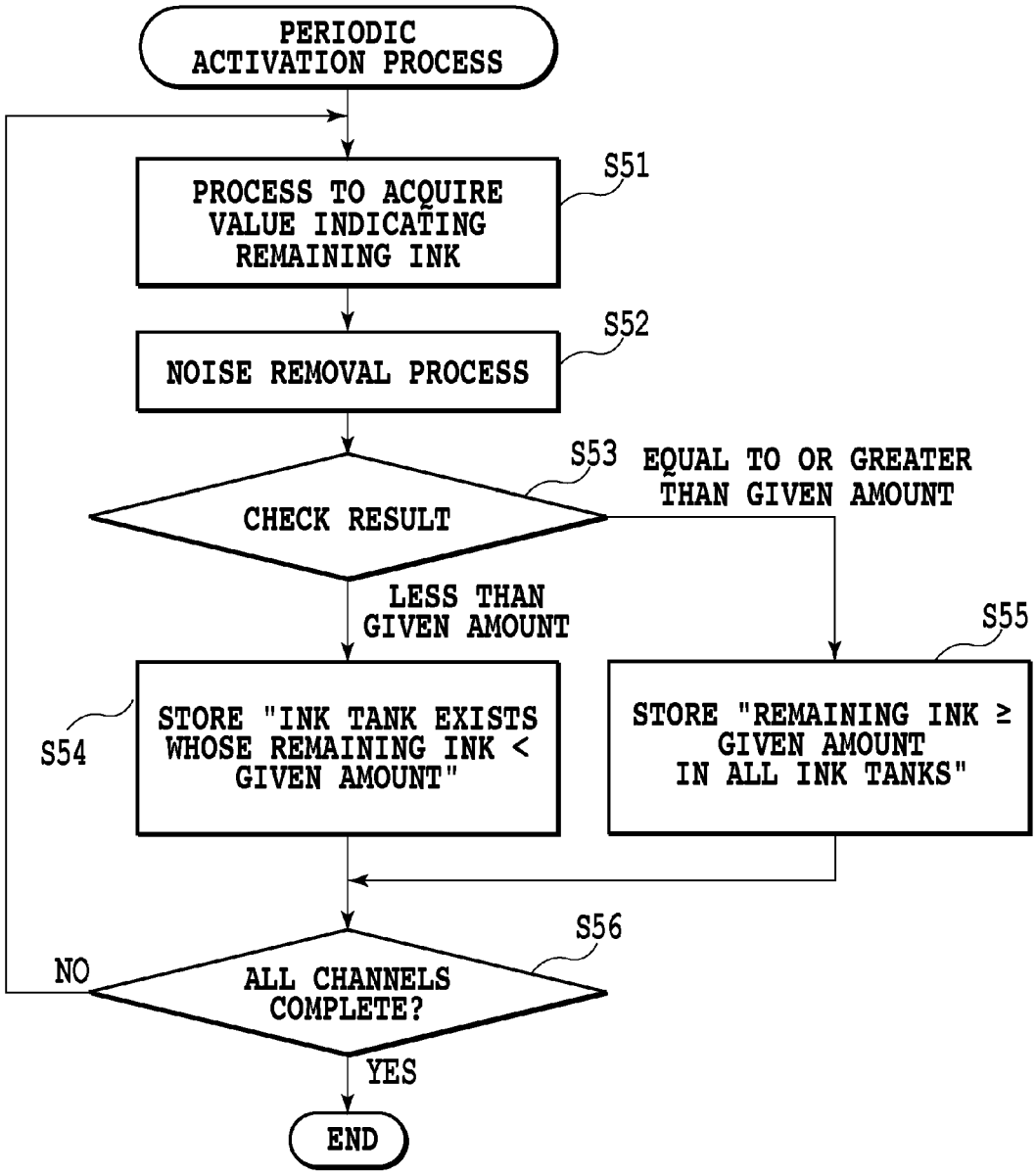
FIG. 4 is a flowchart of a remaining ink detection process in the printing apparatus in FIG. 1.

FIG. 4 is a flowchart illustrating a periodic activation process that is periodically activated in accordance with an embodiment of the present invention. This process is activated at a 10 ms interval and executed in order to monitor the presence of any ink tanks whose remaining ink is less than a given amount. First, in step S51 a value obtained by AD converting the voltage of the optical sensors 6 output to the channel 6-*i*, or in other words a value indicating any remaining ink by the output of that ink group, is acquired. Next, in step S52 in the present embodiment, a five-cycle moving average that includes a history of the previous four periodic activation processing results is taken as a noise removal process. After that, the value is checked in step S53, and if less than a given amount, "ink tank exists whose remaining ink is less than given amount" is stored in step S54. If the value is equal to or greater than a given amount, "remaining ink is equal to or greater than given amount in all ink tanks" is stored in step S55. After that, the above process is also conducted on the channel 6-*j*, the apparatus is monitored for any inks coupled to the channel having an amount less than a given amount. When the above process is complete for all channels (step S56), the process ends.

FIG. 5 is a flowchart of an ink tank level determination process given as a second processing means in accordance with an embodiment of the present invention. Before this flow is carried out, in step S37 of FIG. 3 the remaining ink detector 6 is made to suspend a remaining ink detection process for a channel which is activated at a 10 ms interval and executed, and a second mode, i.e. a mode that detects the remaining amount of a specified ink, is set for a channel.

First, in step S61, the cyan ink optical sensor 6-*a* is specified for the channel 6-*i* and the light gray ink optical sensor 6-*e* is specified for the channel 6-*j*. Next, in step S62, values indicating any remaining ink output from the channels 6-*i* and 6-*j* are acquired five times at a 10 ms interval. In step S63, a noise removal process similar to that of step S52 in the periodic process in FIG. 4 described above is conducted. After that, the results are checked in step S64, and in step S65 information indicating that the remaining amounts of cyan and light gray ink are less than a given amount is respectively stored. In step S66, information indicating that the remaining amounts of ink are equal to or greater than a given amount is stored.

After that, the above process is sequentially repeated for magenta, yellow, and black on the channel 6-*i*, and for dark gray, light cyan, and light magenta on the channel 6-*j*, and it is determined for all inks whether or not the remaining ink is less than a given amount (step S67).

In the present embodiment, the flow in FIG. 5 is carried out in the case where the remaining ink is less than a given amount in one of the groups, but the remaining amount for each color is checked in detail even for the channel not determined to have an ink whose remaining amount is less than a given amount. However, it is possible to conduct an ink level determination process on just the inks of the channel for which the ink group output results indicate that remaining ink is less than given level, in order to simplify software processing and save time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-194741, filed Aug. 31, 2010, which is hereby incorporated by reference herein in its entirety.

What is claimed is:

1. An inkjet printing apparatus, comprising:

a supplying unit that supplies ink to a print head via a tube by pressurizing ink in a plurality of ink tanks where ink is respectively stored;

a moving mechanism that causes the print head to move;

a controller that controls the print head, the supplying unit, and the moving mechanism so as to cause an image to be printed;

a remaining ink detector that detects the amount of remaining ink in each ink tank while in a state where the ink in the plurality of ink tanks is pressurized;

a first processing unit that divides the plurality of ink tanks into a plurality of groups and detects for each group if there exists an ink tank whose remaining ink is less than a given amount from the detection results of the remaining ink detector;

a second processing unit that determines for each in the plurality of ink tanks if the remaining ink is less than a given amount from the detection results of the remaining ink detector; and memory that stores the detection results of the first processing unit, wherein the controller periodically activates the first processing unit while executing printing operations, and in the case where the information stored in the memory indicates that there exists a group having an ink tank whose remaining ink is less than a given amount, suspends the first processing unit, activates the second processing unit, and determines the ink tank whose remaining ink is less than a given amount.

2. The inkjet printing apparatus according to claim 1, wherein the remaining ink detector includes a first mode that outputs, for each in the plurality of groups, the logical sum of remaining ink detection results for each ink tank, and a second mode that outputs the remaining ink detection results for an ink tank specified within each group, and the controller sets the remaining ink detector to the first mode when activating the first processing unit, and sets the remaining ink detector to the second mode and detects remaining ink by respectively specifying ink tanks within each group when activating the second processing unit.

3. The inkjet printing apparatus according to claim 1, wherein the controller causes printing by the print head to continue in the case where a group having an ink tank whose remaining ink is less than a given amount is detected by the first processing unit, but then the detection results for all ink tanks obtained by the second processing unit indicate that the remaining ink is equal to or greater than a given amount.

4. The inkjet printing apparatus according to claim 1, further comprising:

a cap mechanism that uses a cap member to seal the nozzle forming face of the print head, wherein the controller seals the print head with the cap mechanism in the case where the second processing unit is activated and an ink tank whose remaining ink is less than a given amount is detected.

5. The inkjet printing apparatus according to claim 1, wherein after a group having an ink tank whose remaining ink is less than a given amount is detected by the first processing unit, the controller determines whether or not the remaining ink is less than a given amount with the second processing unit, but only for the ink tanks in that group.

6. The inkjet printing apparatus according to claim 5, wherein the remaining ink detector includes a first mode that outputs, for each in the plurality of groups, the logical sum of remaining ink detection results for each ink tank, and a second mode that outputs the remaining ink detection results for an ink tank specified within each group, the controller sets the remaining ink detector to the first mode when activating the first processing unit, and sets the remaining ink detector to the second mode when activating the second processing unit, and in the case where a group having an ink tank whose remaining ink is less than a given amount is detected by the first processing unit, the controller determines the amount of the remaining ink in each ink tank with the second processing unit, but only by specifying the ink tanks in that group.

7. The inkjet printing apparatus according to claim 5, wherein the controller causes printing by the print head to continue in the case where it is determined by the second processing unit whether or not the remaining ink is less than a given amount in the ink tanks in a group having an ink tank whose remaining ink is less than a given amount, and from the results it is determined that the remaining ink is equal to or greater than a given amount for all ink tanks within that group.

8. An inkjet printing apparatus comprising:

a print head configured to eject ink;

a plurality of ink tank groups, each ink tank group comprising a plurality of ink tanks that store respective inks;

a plurality of supply lines configured to respectively supply ink from the plurality of ink tanks to the print head;

a plurality of detectors respectively provided along the plurality of supply lines, each detector is configured to detect a corresponding amount of remaining ink in a corresponding ink tank of the plurality of ink tanks;

a control unit configured to control the detector to perform a first determining operation of determining whether an ink tank group includes an ink tank in which a remaining ink amount is less than a given amount, and wherein the control unit is further configured to, in a case where it is determined in the first determining operation that there is an ink tank group that includes an ink tank in which the remaining ink amount is less than the given amount, cause the plurality of detectors to perform a second determining operation to determine if respective remaining ink amounts in the plurality of ink tanks included in the ink tank group are less than the given amount.

9. The inkjet printing apparatus according to claim 8, wherein the first determining operation is performed based on a logical sum of detection results of the remaining ink amounts in each of the plurality of ink tanks in each ink tank group.

10. The inkjet printing apparatus according to claim 8, wherein the control unit is further configured to, in a case where it is determined in the first determining operation that there is not an ink tank group that includes an ink tank in which a remaining ink amount is less than the given amount, continue a printing operation by the print head.

11. The inkjet printing apparatus according to claim 8, further comprising:

a cap configured to cap an ejection port face of the print head, wherein in the case where it is determined in the second determining operation that there is at least one ink tank in which the remaining ink amount is less than the given amount, the control unit causes the print head to be capped by the cap.

* * * * *